United States Patent [19]

Shepard et al.

[11] 4,391,685

[45] Jul. 5, 1983

[54] PROCESS FOR ELECTROLYTICALLY PICKLING STEEL STRIP MATERIAL

[75] Inventors: George A. Shepard, Parma; Philip C. Schillawski, Broadview Heights, both of Ohio

[73] Assignee: Republic Steel Corporation, Cleveland, Ohio

[21] Appl. No.: 238,430

[22] Filed: Feb. 26, 1981

[51] Int. Cl.[3] ..... C25F 1/06

[52] U.S. Cl. ..... 204/145 R

[58] Field of Search ..... 204/145 R

[56] References Cited

U.S. PATENT DOCUMENTS

| | | | |
|---|---|---|---|
| 2,165,326 | 7/1939 | Yerger | 204/145 R |
| 3,043,758 | 7/1962 | Machu | 204/145 |
| 3,304,246 | 12/1963 | Fukui et al. | 204/145 |
| 3,450,610 | 6/1969 | Froden | 204/145 |
| 3,642,586 | 2/1972 | Shepard et al. | 204/34 |
| 3,650,935 | 3/1972 | Andersson | 204/206 |
| 3,926,767 | 12/1975 | Brendlinger et al. | 204/206 |
| 4,012,299 | 3/1977 | Zaremski et al. | 204/141.5 |
| 4,129,485 | 12/1978 | Shikata et al. | 204/145 |

FOREIGN PATENT DOCUMENTS

| | | | |
|---|---|---|---|
| 550491 | 12/1957 | Canada | 204/145 R |
| 2431554 | 3/1980 | France | 204/145 R |

*Primary Examiner*—T. M. Tufariello

*Attorney, Agent, or Firm*—Watts, Hoffmann, Fisher & Heinke

[57] ABSTRACT

A method for efficiently and effectively continuously electrolytically pickling a steel strip by subjecting the strip to the action of direct current in an aqueous neutral salt pickling solution wherein the strip to be pickled forms a conductor between the neutral salt pickling solution containing the cell cathode and an anolyte containing the cell anode wherein the anolyte is electrically isolated from the neutral salt pickling solution.

6 Claims, 2 Drawing Figures

PROCESS FOR ELECTROLYTICALLY PICKLING STEEL STRIP MATERIAL

Technical Field

This invention relates to a metal pickling or descaling process, and more particularly to a continuous electrolytic process for pickling alloy steel, especially stainless steel.

BACKGROUND ART

The present invention is an improvement over prior art electrolyte pickling processes and particularly the process of U.S. Pat. No. 3,043,758. That patent discloses a method of electrolytic pickling characterized by the use of an aqueous electrolyte containing at least one neutral salt and having a pH of from 1.0 to 7.0. In the practice of the method disclosed in the patent, the anode and the cathode are arranged in a single, bi-polar cell containing the electrolyte. Since both the anode and the cathode are contained in a single bath, current can travel between the two electrodes thus lowering the electrical efficiency of the descaling operation. Electrolytic pickling is carried out at relatively high temperatures in order to increase efficiency. When the anode and the cathode are in the same bath, the entire bath must be heated even though only the portion of the pickling cell where the steel article acts as an anode is effective in descaling.

DISCLOSURE OF THE INVENTION

The present invention is an improvement in the known process of electrolytically pickling stainless steel strip and the like by subjecting it to the action of direct current in a bi-polar pickling cell. The improvement consists generally of the steps of passing a direct current through the strip to be pickled as a conductor between a neutral salt pickling bath containing the cell cathode and an anolyte containing the cell anode which is remote from the pickling bath. As used herein, the term "anolyte" will be understood to mean the electrolyte bath that contain the cell anode connected in the direct current circuit.

The new concept of electrically isolating the cell anode means from the neutral salt pickling bath containing the cell cathode means improves the electrical efficiency of the process, reduces material and operating costs, lowers heat energy requirements, and provides other important advantages. A more effective use of current is achieved because the anode and cathode are electrically isolated from each other except for the conduction of current through the strip itself. It is not possible for the current to partially bypass the strip and flow through the electrolyte as occurs in the bi-polar cell arrangement of the prior art.

In accordance with the invention, the current is introduced into the strip in an anolyte bath which may be a mineral acid, such as sulfuric acid or the like. The anolyte is less expensive than the neutral salt pickling bath and need not be heated. This results in a lower heat load and lower fuel costs than required by the conventional practice in which both the anode and the cathode were located in the neutral salt pickling bath, thus requiring the entire bath to be heated even though descaling took place in only a portion of it. In the process of the invention, descaling is accomplished within the entire neutral salt pickling bath.

Preferably the pickling bath contains at least one neutral salt such as sodium sulfate. Advantageously the neutral salt pickling solution and the anolyte have the same anion thus preventing drag-over contamination.

It is also found advantageous to pass the strip through anolyte baths located both upstream and downstream of the neutral salt pickling bath. This arrangement makes it possible to increase the line speed and use the current efficiently in the space allowed for descaling.

In the preferred arrangement of the present invention, the downstream sulfuric acid bath, in addition to serving as an anolyte, is effective to reduce the $Cr^{+6}$ ion to $Cr^{+3}$. It is known that descaling with neutral salt generates $Cr^{+6}$ ions. In conventional practice, the stainless steel strip exiting the neutral salt bath normally carries over some of the $Cr^{+6}$ ions into the post-treatment hot tub. The usual practice to prevent this has been to water rinse the strip before going into the hot tub. As a result, the rinse water is contaminated with the $Cr^{+6}$ ion and must be chemically treated to reduce the ion to $Cr^{+3}$ before disposal to the environment. The present invention saves the cost of providing a separate rinse water chemical treatment facility for this purpose.

Practice of the instant inventive method so materially improves descaling that temperature and acid concentration requirements of a post treatment in a "hot tub" of a dilute aqueous solution of a mineral acid at elevated temperatures are reduced. This allows for significant reduction in the consumption of acid in the hot tub as well as a reduction in the $NO_x$ emissions when using nitric acid in the hot tub.

These and other features of the present invention will become more apparent as the invention becomes better understood from the detailed description that follows, when considered in connection with the accompanying drawings.

BEST MODE FOR CARRYING OUT THE INVENTION

Figure 1:
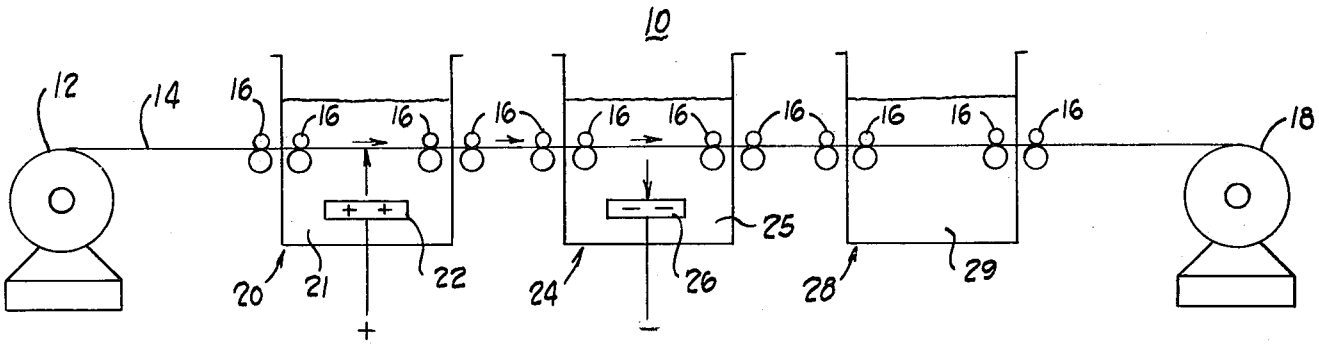
FIG. 1 is a schematic representation of one embodiment of the instant invention.

Referring to FIG. 1 there is shown an electrolytic pickling apparatus 10 which contains a pair of electrically isolated tubs or compartments 20, 24 having similar unit construction and positioned in series. The tubs 20, 24 are adapted to receive an aqueous solution of electrolyte and at least one inert electrode.

The tub 20 contains an inert anode 22 of lead or the like which is connected to the positive side of a DC power source (not shown) and a suitable anolyte 21. The tub 24 contains an inert cathode 26 of stainless steel or the like, connected to the negative side of the DC power source and an aqueous neutral salt pickling solution 25. The pickling solution 25 in the tub 24 is heated to a pickling temperature by energizing an appropriate heater means (not shown).

Positioned in series with the tubs 20, 24 is a hot tub 28 containing a final pickling solution 29 of dilute acid. The final pickling solution 29 contained in the tub 28 is heated to an appropriate temperature by energizing a heater means (not shown).

A steel strip 14 contained on a payoff reel 12 is passed over and around rollers 16 which continuously convey the strip through each of the tubs successively in a substantially horizontal position. The strip is gathered on a take-up reel 18.

In operation, the steel strip 14 continuously passes through the tubs 20, 24, 28. A DC potential is applied across the anode 22 and the cathode 26. The strip 14 then forms a conductor between the anolyte 21 in tub 20 and the neutral salt pickling solution 25 in tub 24 to complete the circuit. The strip 14 conducts current between the anolyte 21 in the tub 22 and the neutral salt pickling solution 25 in the tub 24 with the electrons flowing in the direction of the arrows as shown in FIG. 1.

The strip portion pickled in the tub 24 passes through the heated final pickling solution 29 contained in the hot tub 28 and is gathered on the take-up reel 18.

The electrolyte pickling solution 25 can be any of those aqueous solutions disclosed in U.S. Pat. No. 3,043,758 characterized by the presence of at least one neutral salt. The neutral salts are preferably present in concentrations of from about 5% to about 25% by weight. The exact choice of the pickling neutral salt electrolyte depends upon the steel strip to be pickled, the temperature at which pickling will occur, and the current density. The most preferred pickling electrolytes are aqueous solutions of sodium salts including sulfates and nitrates.

The anolyte 21 is an aqueous solution containing at least one ionically dissociated substance. It is preferred that a solution of a mineral acid be utilized. Acids such as sulfuric, hydrochloric and nitric are useful. When sulfuric acid is utilized concentrations of from about 3% to about 10% by weight at temperatures from about ambient to about 100° F. are found sufficient. Generally when sulfate salts are used in the neutral salt pickling bath, sulfuric acid is preferred as the anolyte. It is useful to have the anion of the anolyte and the neutral salt pickling solution the same, in order to prevent contamination by drag-over.

The immersion time, current density and temperature utilized within the neutral salt pickling bath will be dependent upon the material to be descaled and are generally well known to the skilled artisan. Generally immersion times in the pickling electrolyte of from about 4 to 10 seconds is sufficient. Current densities in excess of 0.1 amps per square inch are sufficient and pickling electrolyte temperatures are usually in the range of about 80° F. to about 212° F. and preferably from 120° F. to 180° F. Line speeds will vary with required exposure times, material, temperatures, and current densities.

It will be realized in accordance with the instant invention that one or more neutral salt pickling baths containing a cathode means and one or more anolyte baths containing an anode means can be used in series.

Figure 2:
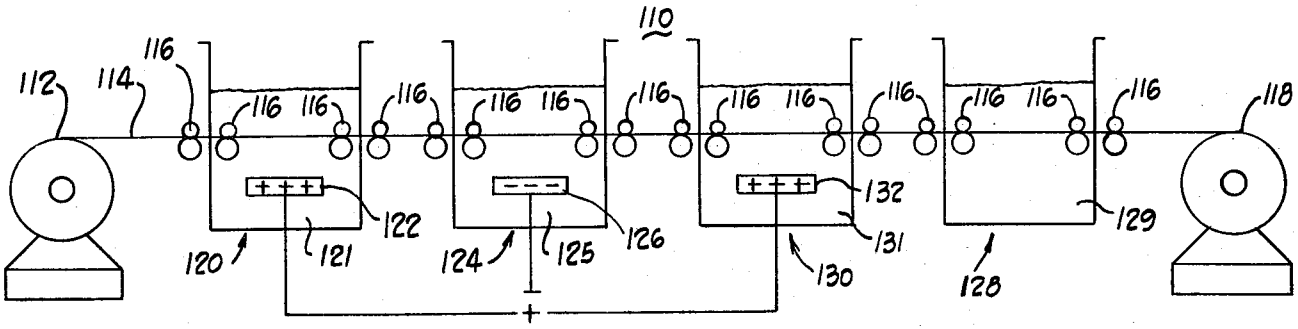
FIG. 2 is a schematic representation of another embodiment of the instant invention.

Referring now to FIG. 2 there is shown an apparatus for practicing a particularly advantageous embodiment of the inventive method. The corresponding one hundred series numbers of FIG. 2 identify identical apparatus previously described in connection with the discussion of FIG. 1. Pickling apparatus 110 contains three tubs 120, 124, 130 positioned in series. The tubs 120, 130 are substantially identical, containing anolyte solution 121, 131, respectively and anodes 122, 132, respectively which are connected to the positive lead of a DC power source (not shown).

Thus in accordance with the embodiment shown in FIG. 2 there are provided two substantially identical anolyte baths, one upstream of pickling vessel 124 and the other downstream of pickling vessel 124. The additional anolyte bath enables a constant current density to be applied across the entire length of the strip 114 in contact with the neutral salt pickling solution 125 in vessel 124. The strip is finally subjected to final pickling solution 129 contained in the hot tub 128.

Although the invention is believed to be adaptable to a number of metals, alloys of steel presently appear to constitute the most significant part thereof. For this reason the following examples are directed to the removal of scale from stainless steel.

The following examples are given by way of illustration of the nature of the instant invention but are not intended to be limitations on the scope thereof.

EXAMPLE I

In this example a series of different alloys of stainless steel strips were successfully descaled in accordance with the instant invention utilizing the apparatus described in FIG. 1.

The tub 20, contained a lead anode and an aqueous anolyte of from 5% to 15% by volume of sulfuric acid. The anolyte was maintained at room temperature (ambient). The tub 24 contained a stainless steel cathode and an aqueous pickling solution of from 15% to 23% by weight sodium sulfate. The neutral salt pickling solution was heated to and maintained at about 160° F.

The final pickling tub 28 contained a solution of from 1.0 to 2.0% HF and 3.5 to 8.0% $HNO_3$ which solution was maintained at a temperature of about 150° F.

A.I.S.I. grades 304, 309, 301, 436, 316, and 430 of stainless steel alloy strip were conveyed through the described apparatus at currents ranging from 1000 to 4000 amps adjusted to give current densities ranging from 50 to 100 amps per square foot. The DC voltage applied across the cell was varied from 18 to 29 volts and the line speed i.e., the speed at which the strip was conveyed through the system, was from 10 to 30 feet per minute. Adjustment in line speed and current were made to accommodate different widths and guages.

In each case the material was successfully descaled.

EXAMPLE II

Using the apparatus as described in Example I a coil of A.I.S.I. 304 alloy steel was successfully descaled at line speed of 11 feet per minute using 3800 amps at an effective DC voltage of 22 volts.

EXAMPLE III

This example shows the unexpected benefit of descaling in accordance with the instant invention as opposed to prior art using a bi-polar cell. The success of a descaling method can be determined by the requirement of final pickling in a hot tub which follows the electrolytic descaling. Steel strip materials descaled in accordance with the instant invention were subjected to a final pickling treatment at 150° F. with 1.0 to 2.0% HF and 3.5 to 8.0% $HNO_3$ by weight in order to obtain desired finished strip.

This contrasts with the final treatment necessary for pickling conventionally descaled material requiring a temperature of 180° F. and acid concentrations of from 2.0 to 4.0% HF and 5.0 to 10% $HNO_3$. The instant invention permits a cost savings by reducing hot tub temperature and acid concentration as well as reducing $NO_x$ emissions.

While the invention has been explained in relation to its preferred embodiment, it is understood that various modifications thereof become apparent to those skilled in the art upon reading the specification and it is intended to cover such modifications as fall within the scope of the appended claims.

We claim:

1. In a process for electrolytically pickling a steel strip material by subjecting the material to the action of direct current in a pickling bath which contains at least one neutral salt, the improvement comprising the steps of passing the direct current through the strip to be pickled as a conductor between a uni-polar neutral salt pickling bath containing a cathode means an an acid anolyte bath containing an anode means, said acid anolyte bath being remote from said pickling bath.

2. The process of claim 1 wherein anolyte baths are located upstream and downstream of said pickling bath.

3. The process of claim 2 wherein the neutral salt pickling bath and the anolyte bath have the same anion.

4. The process of claim 3 wherein the anion is the sulfate ion.

5. In a process for electrolytically pickling a steel strip by subjecting it to the action of direct current in a pickling bath which contains at least one neutral salt, the improvement comprising the steps of introducing the direct current into the strip to be pickled by anode means contained in an aqueous sulfuric acid bath, thereafter pickling the strip while anodic in a uni-polar neutral salt pickling bath containing cathode means, and then passing the strip while it is cathodic through another aqueous sulfuric acid bath containing anode means, and sulfuric acid baths being located upstream and downstream from said pickling bath and isolated therefrom.

6. The process of claim 5 wherein said pickling bath comprises an aqueous solution of sodium sulfate.

* * * * *